United States Patent [19]

Kerfoot et al.

[11] Patent Number: 4,484,626

[45] Date of Patent: Nov. 27, 1984

[54] PNEUMATIC PACKER

[75] Inventors: William B. Kerfoot, Falmouth; Stuart M. Skinner, Jr., Marion, both of Mass.

[73] Assignee: K-V Associates, Inc., Falmouth, Mass.

[21] Appl. No.: 486,266

[22] Filed: Apr. 15, 1983

[51] Int. Cl.[3] ..... E21B 33/124

[52] U.S. Cl. ..... 166/191; 73/155; 277/2; 277/34; 166/187

[58] Field of Search ..... 166/51, 66, 113, 127, 166/155, 191, 278; 73/155; 277/2, 34, 34.3, 34.8

[56] References Cited

U.S. PATENT DOCUMENTS

| | | | |
|---|---|---|---|
| 2,633,200 | 3/1953 | Humason | 166/127 |
| 3,592,056 | 7/1971 | Bernaix | 73/194 |

FOREIGN PATENT DOCUMENTS

| | | | |
|---|---|---|---|
| 617587 | 7/1978 | U.S.S.R. | 73/155 |
| 726317 | 7/1980 | U.S.S.R. | 73/155 |

*Primary Examiner*—Stephen J. Novosad

*Assistant Examiner*—Michael Starinsky

*Attorney, Agent, or Firm*—Diller, Ramik & Wight

[57] ABSTRACT

A pneumatically inflated packer assembly includes spaced upper and lower inflatable sleeves which expand radially to anchor the assembly at a desired depth within a well screen. A porous, elastic bag exteriorly covers these sleeves so that the expanded sleeves stretch and tension the bag such that its intermediate portion between the sleeves tends to expand into cylindrical form so that it lies closely adjacent or against the interior surface of the well screen. In this way, a supply of porous material such as sand housed in an open space above the lower sleeve and below the upper sleeve is free to flow or migrate radially outwardly to substantially completely fill the cross section of the well screen. Groundwater flow into the well is now constrained to flow horizontally through the sand so that its direction and flow rate may be measured by a probe penetrating into the sand. The sand may be housed in an elastic, porous bag and a diaphragm may be employed to displace sand upwardly into the open space incidental to sleeve inflation.

19 Claims, 3 Drawing Figures

PNEUMATIC PACKER

CROSS REFERENCE TO RELATED APPLICATION

This invention is intended for use in connection with the groundwater flow meter disclosed and claimed in our copending application Ser. No. 276,787 filed June 24, 1981 and now allowed. The subject matter of this copending application is incorporated herein by reference.

BACKGROUND OF THE INVENTION

Although not necessarily limited thereto, this invention is particularly useful in (1) deep monitoring wells where noninflatable packer bags receive considerable abrasion, (2) in open bore holes where the diameter of the hole varies in width due to irregularities in the natural strata and (3) in fractured or solution-channeled rock where it is necessary to isolate the horizontal flow components from vertical flow components.

The invention allows better documentation of the zones of contribution of water to municipal supply wells and is particularly useful in association with the design and installation of septic systems.

In conditions of uniform, rapid groundwater flow, random positioning of a septic system at a fixed distance from an on-line water supply can cause a short circuiting of leachate, impacting drinking water over 10% of the time. By using groundwater flow directions during site design, significant improvement in protection of water sources can be achieved.

The aforesaid copending application gives five discrete vector component readout which is readily resolved to direction and velocity of groundwater flow. By determining direction and rate of flow of subsurface groundwater flow into the source of drinking water, the septic system can be designed and sited to minimize short circuiting of leachate into the drinking water supply.

BRIEF SUMMARY OF THE INVENTION

The present invention is directed to a pneumatic packer which is capable of insertion to any level within a well screen and then expanding under manually applied pneumatic pressure above and below a supply of porous material into which the probe conductors of the aforesaid copending application are inserted for measurement of velocity and direction of groundwater flow through such porous medium at the level at which the packer has been anchored within the well screen. The inflatable anchoring bladders also effectively isolate the porous medium above and below it so as to isolate the porous medium whereby an accurate resolution of direction of groundwater flow into the well may be effected.

Basically, the packer assembly of this invention incorporates an integral unit consisting essentially of upper and lower sections surrounded by pneumatic packing sleeves which are effective to expand outwardly and anchor and seal against the internal surface of a well screen and thereby effectively isolate the porous medium section located therebetween. The porous medium section is in the form of a cage surrounded by an elastic bag containing a supply of the porous medium into which the probe conductors of the aforesaid copending application are inserted. The whole of the assembly is surrounded by a porous, elastic envelope the purpose of which is to allow its expansion outwardly with the packer or anchoring sleeves so that essentially the whole of the outer envelope is forced outwardly either directly to contact the well screen or to lie closely adjacent thereto. This permits the elastic bag containing the porous medium to bulge or expand outwardly under the weight of the porous medium so that the porous medium effectively fills the entire cross-section of the well screen and thereby assures that the components of the groundwater flow are accurately recorded.

It is a feature of the invention that the packer assembly contains an internal membrane or diaphragm which is effective automatically upon inflation/anchoring of the device to displace more of the porous medium into the elastic bag containing it.

BRIEF DESCRIPTION OF THE DRAWING FIGURES

DETAILED DESCRIPTION OF THE INVENTION

Figure 1:
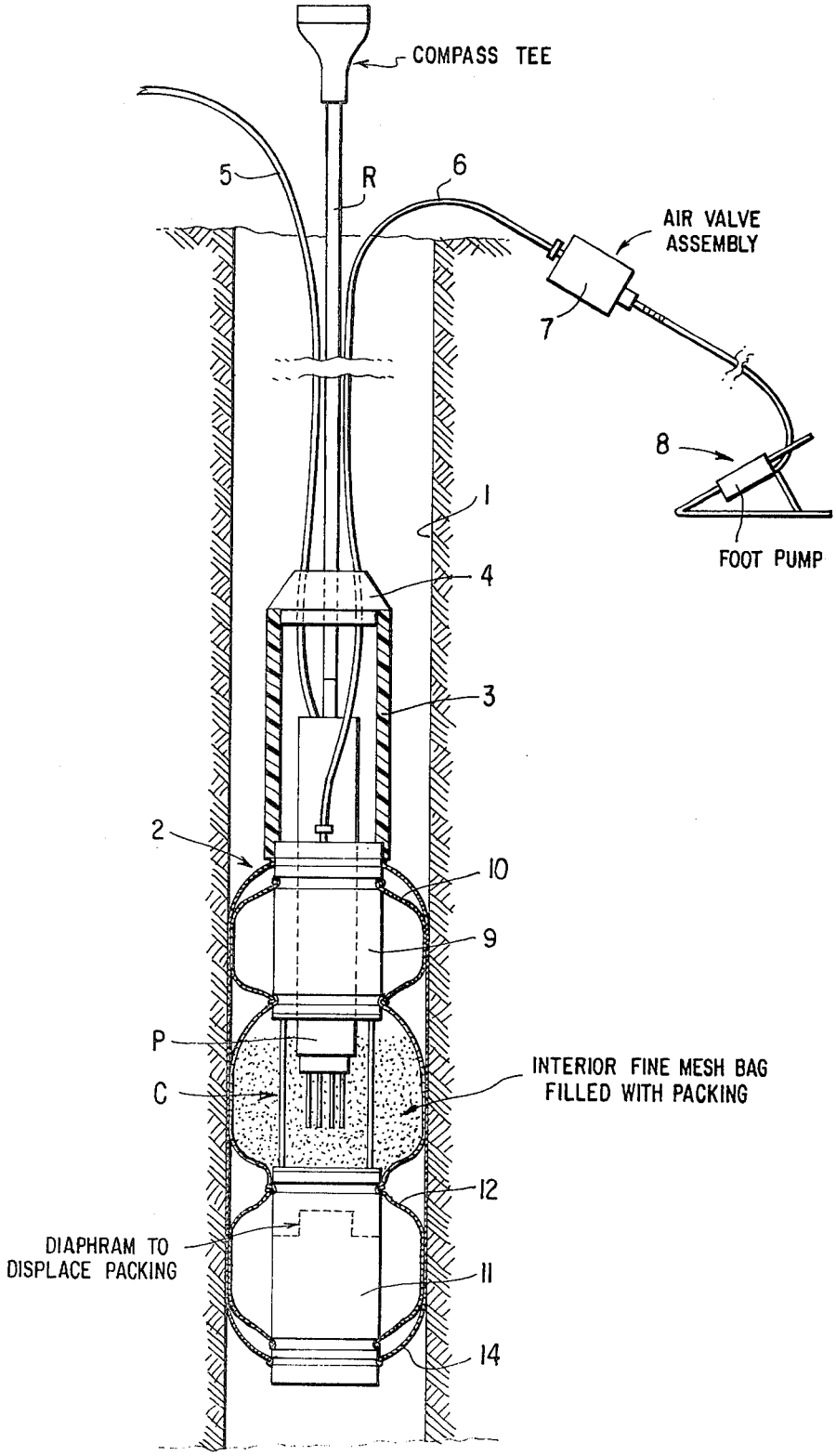
FIG. 1 is a schematic view illustrating the general arrangement of the invention.

As shown in FIG. 1, a porous well screen 1 lines a borehole for a drinking water well and into which the packer assembly indicated generally by the reference character 2 is inserted. The packer assembly 2 includes an upper cylinder section 3 and a cap 4 which form an integral unit with the packer assembly 2 as shown. The probe P is located within the assembly, removably so when the cap 4 is removed and the probe is carried at the lower end of a length of rod R which is provided at its upper end with a compass tee which allows the compass to be oriented specifically with respect to the conductor probe at the lower end of the probe body P so that the specific and particular direction of groundwater flow can be established.

The assembly includes the multiwire conductor 5 which extends from the probe body P to the electronics of the deck box for measuring groundwater flow and direction in accord with our aforesaid copending application. Additionally, a length of tubing 6 is connected in functional relationship with the upper hub section 9 of the packer assembly and extends therefrom through the air valve assembly 7 to the foot pump assembly 8, the purpose of which will be readily apparent.

The packer assembly includes not only the upper hub assembly 9 but the lower hub assembly 11 which respectively have associated therewith the expansion bladder sleeves 10 and 12 which in FIG. 1 are shown expanded outwardly to press against and anchor at a particular depth within the well screen 1. The whole of this device is covered with an external elastic bag which is also porous to allow the groundwater flow therethrough freely. As will be seen from FIG. 1, when the two bladders 10 and 12 are expanded into anchoring relationship with the well screen, the external bag because it is expanded outwardly adjacent its opposite ends which are anchored to the packer assembly, the main section of this bag between such anchoring points is stretched so that it tends to be longitudinally tensioned so that it lies against or at least very closely adjacent to the interior surface of the well screen 1, substantially as is shown in FIG. 1. This allows the elastic porous bag 13 which is located between the two bladders 10 and 12 to bulge or expand outwardly under the action of the weight of the porous material located therewithin, as indicated in FIG. 1, so that the elastic bag 13 also bulges or swells radially outwardly to fill substantially the entire cross-section of the area of the well screen 1. The packing material may be sand or other substance but it has sufficient weight in and of itself so as to cause the bulging or outward swelling of the elastic bag 13. To aid in this process, as will be more clearly understood from further description of the invention in connection with FIG. 2, a diaphragm is located in the lower section 11 which displaces the sand or packing material upwardly into the bag 13 as it swells and expands to the position shown in FIG. 1.

Figure 2:
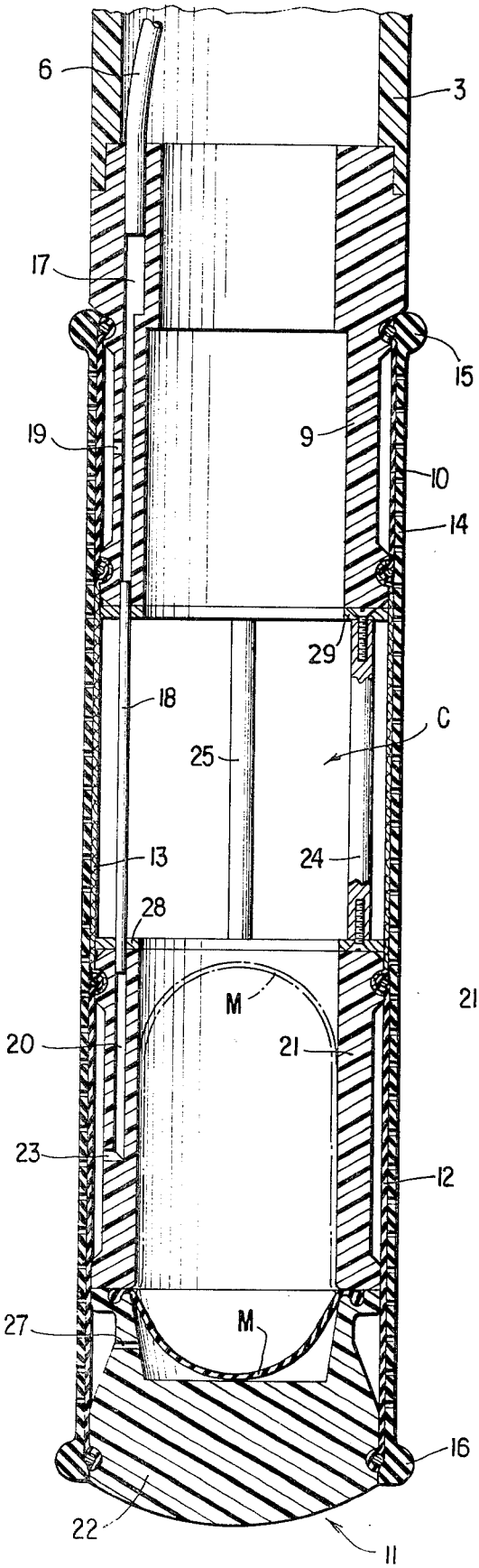
FIG. 2 is an enlarged vertical section taken through the principal portion of the packer assembly.

Referring now to FIG. 2, certain details of the packer will be evident therefrom.

As will be seen, the lower end of the upper cylinder 3 receives the upper end of the section 9 which is of tubular configuration and these two are suitably secured together as by threaded connectors or other suitable means which prevent axial separation between these members. As shown, the elastic sleeve 10 normally snugly fits the upper and lower portions of the section 9 and is anchored thereto by suitable means such as a lock ring LR similar to the arrangement shown in FIG. 3 which will described hereinafter. FIG. 2 also clearly shows the outer porous sleeve 14 which has reinforcing beads or edges 15 and 16 at its upper and lower ends respectively which serve respectively to grip the upper portion of the section 9 and the lower portion of the section 22 substantially as is shown. The end section 22 forms with the section 21 the lower hub assembly 11 previously described. The two portions 21 and 22 are anchored together by means of screw thread fasteners as illustrated so as to clamp the membrane M therebetween, the membrane M having an annular bead 26 which is fitted in a groove in the section 22 securely to anchor it and effect a seal thereat.

Between the two sections 9 and 11, there is the cage C which is formed by the two rings 28 and 29 spaced apart by a series of rods 24, 25 and which cage is surrounded by the aforesaid porous bag 13. The two rings 28 and 29 also carry a tube 18, substantially as is shown, the opposite ends of which fit into the passages 17 and 20 of the two sections 9 and 21. The passage 17 is provided with a bleed opening 19 whereas the passage 20 is provided with a bleed opening 23. Thus, when the foot pump 8 is operated through the checkvalve 7, the tubing 6 supplies air under pressure to the passageway system and causes the outward inflation of the sleeves 10 and 12 as described hereinabove.

Figure 3:
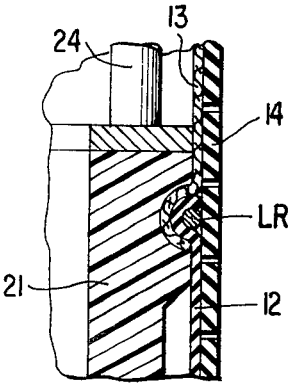
FIG. 3 is an enlarged view of a portion of the packer assembly as indicated.

The elastic bag 13 is anchored at its upper and lower ends respectively together with the lower and upper ends of the sleeves 10 and 12, substantially as is shown in FIG. 3. As shown in FIG. 3, the member 21 is provided with a groove at which the lower and upper ends respectively of the bag 13 and the sleeve 12 are overlapped and a suitable lockring LR is tightly gripped therearound to force the material of these two members 13 and 12 into the groove and effect a seal and anchor thereat.

Prior to assembling the device with the probe P associated therewith and lowering it into the well bore, a supply of the packing or sand which cooperates with the probe P as described in our aforesaid copending application, is poured into the interior of the assembly shown in FIG. 2 on top of the membrane M substantially up to the level of the top of the ring 29 of the cage C. Thus, when the bag 13 swells or bulges outwardly under the weight of this sand, the level of the sand or packing will materially drop but for the presence of the membrane M which through its bleed passage 27 is pressurized on its lower side to swell upwardly as shown by dashed lines in FIG. 2 to displace the sand upwardly into the interior of the cage C and allow the sand or other porous material to flow radially outwardly and substantially entirely fill the cross-section of the well screen. In this way, the groundwater flow which normally passes through the well screen and then downwardly into the borehole is constrained to pass horizontally through the porous packing material so that the direction and flow rate of this groundwater flow may be determined and without passing around or short circuiting the porous material (because it fills the cross section) such as would lead to erroneous readings.

What is claimed is:

1. An assembly which permits measurement of direction and flow rate of a fluid entering into a borehole, said assembly comprising upper inflatable means and lower inflatable means and an elastic, porous sleeve having upper and lower portions respectively overlapping said upper and lower inflatable means whereby an intermediate portion of said porous sleeve lies between such means, inflating means for causing said upper and lower inflatable means to expand radially so that said upper and lower portions of said porous sleeve anchor and seal within a borehole with said intermediate portion of the porous sleeve being stretched and tensioned so that it expands to cylindrical form generally conforming to the borehole, open cage means disposed between said upper inflatable means and said lower inflatable means and surrounded by said intermediate portion of the porous sleeve whereby to define an open space containing a supply of particulate material which flows outwardly as said intermediate portion is expanded to substantially completely fill the cross section of the borehole.

2. An assembly as defined in claim 1 including a second porous, elastic sleeve surrounding said cage means and housing said particulate material.

3. An assembly as defined in claim 2 including means responsive to inflation of said inflatable means for displacing said particulate material into said open space.

4. An assembly as defined in claim 1 including means responsive to inflation of said inflatable means for displacing said particulate material into said open space.

5. An assembly which permits measurement of direction and flow rate of a fluid entering into a borehole, said assembly comprising a supporting frame and an external sleeve of porous, elastic material enclosing a length of said frame, upper expandable means disposed between said frame and an upper portion of said porous sleeve for radially expanding to press said upper portion of said porous sleeve outwardly in anchoring relation to a borehole, lower expandable means disposed between said frame and a lower portion of said porous sleeve for radially expanding to press said lower portion of said porous sleeve outwardly in anchoring relation to a borehole, said upper and lower means being spaced apart whereby an intermediate portion of said porous sleeve is stretched and tensioned as said upper and lower means are expanded so that said intermediate portion assumes a cylindrical form closely conforming to the borehole, said frame defining an open region surrounded by said intermediate portion of the porous sleeve, and a supply of particulate material contained within said open region and being free to follow the radial expansion of said intermediate portion of the porous sleeve to fill the cross section of the borehole.

6. An assembly which permits measurement of direction and flow rate of a fluid entering into a borehole, said assembly comprising an upper section, a lower section and an intermediate section containing a supply of particulate material, said upper section including expandable means for pressing outwardly against a borehole to anchor sealingly thereagainst, said lower section including expandable means for pressing outwardly against a borehole to anchor sealingly thereagainst, said expandable means when expanded being effective to constrain the flow of fluid into said borehole to pass horizontally through said intermediate section and said supply of particulate material contained therein.

7. An assembly as defined in claim 6 wherein said upper section is of tubular construction and the expandable means associated with it is an elastic sleeve surrounding anchored at its opposite ends to the upper section.

8. An assembly as defined in claim 7 wherein said lower section includes an upper tubular portion and a bottom cap and the expandable means associated therewith is an elastic sleeve surrounding and anchored at its opposite ends to the lower section.

9. An assembly as defined in claim 7 wherein the side wall of the tubular construction of said upper section is provided with an axial throughbore for receiving pressurized air and said side wall is provided with a bleed opening to inflate the sleeve surrounding said upper section.

10. An assembly as defined in claim 8 wherein the side wall of the tubular construction of said upper section is provided with an axial throughbore for receiving pressurized air and said side wall is provided with a bleed opening to inflate the sleeve surrounding said upper section.

11. An assembly as defined in claim 10 wherein the side wall of said tubular portion of the lower section is provided with a bore communicating with said throughbore and a bleed passage for inflating the sleeve surrounding the lower section.

12. An assembly as defined in claim 11 wherein said intermediate section provides the communication between said bore and said throughbore.

13. An assembly as defined in claim 12 wherein said intermediate section is in the form of a cage.

14. An assembly as defined in claim 13 including a porous, elastic sleeve surrounding said cage and anchored at its opposite ends to the assembly.

15. An assembly as defined in claim 14 wherein said bottom cap is provided with a recess and a diaphragm covering said recess, and including means for upward inflation of said diaphragm in response to the presence of pressurized air in said bore, said diaphragm being adapted to displace said particulate material upwardly into said intermediate section.

16. An assembly as defined in claim 14 including a porous, elastic sleeve surrounding all of said sections and anchored at its opposite ends to said assembly.

17. An assembly which permits measurement of direction and flow rate of a fluid entering into a borehole, said assembly comprising an upper section, a lower section and an intermediate section, said upper section including expandable means for pressing outwardly against a borehole to anchor sealingly thereagainst, said lower section including expandable means for pressing outwardly against a borehole to anchor sealingly thereagainst, said expandable means when expanded being effective to constrain the normal flow of fluid into said borehole to pass horizontally through said intermediate section, a supply of particulate material in said lower section, means for forming a porous wall about said intermediate section, and means for moving said particulate material from said lower section into said intermediate section.

18. The assembly as defined in claim 17 wherein particulate material moving means includes a resilient wall supporting said particulate material, and means for moving said resilient wall in a direction toward said intermediate section to lift said particulate material therein.

19. The assembly as defined in claim 18 wherein said resilient wall moving means is a source of air pressure directed beneath said resilient wall.

* * * * *